United States Patent [19]

Cocozella et al.

[11] 4,010,690

[45] Mar. 8, 1977

[54] MEANS FOR AND METHOD OF PROVIDING A FIRE PROTECTION FOR A CASELESS AMMUNITION

[75] Inventors: Robert A. Cocozella, Chelmsford; Florindo F. Dal Pan, Nabnasset; Thomas M. Finelli, North Andover, all of Mass.; Duane M. Patterson, Nashua, N.H.

[73] Assignee: Avco Corporation, Cincinnati, Ohio

[22] Filed: Apr. 30, 1973

[21] Appl. No.: 355,807

[52] U.S. Cl. ..... 102/97; 102/105; 150/52 H

[51] Int. Cl.² ..... F42B 37/00

[58] Field of Search ..... 102/1 R, 1 G, 86.5, 102/97, 99, 103, 105, DIG. 1; 150/52 H; 220/53; 206/3

[56] References Cited

UNITED STATES PATENTS

| | | | |
|---|---|---|---|
| 693,336 | 2/1902 | Rhodes | 206/3 |
| 3,367,531 | 2/1968 | Ellis | 220/53 |
| 3,520,400 | 7/1970 | Gates | 206/3 |
| 3,559,872 | 2/1971 | Riboud | 206/3 |
| 3,572,499 | 3/1971 | Mondano | 206/3 |
| 3,654,190 | 4/1972 | Levine | 252/8.1 |
| 3,663,463 | 5/1972 | Wren | 117/136 |
| 3,730,094 | 5/1973 | Quinlan | 102/DIG. 1 |
| 3,854,983 | 12/1974 | Brodnyan | 428/328 |

*Primary Examiner*—Stephen C. Bentley
*Attorney, Agent, or Firm*—Charles M. Hogan; Abraham Ogman

[57] ABSTRACT

This invention is directed to the concept of providing fire protection for a caseless ammunition round by enveloping the round in an intumescent material. Means for stripping the intumescent material from the round, together with means for connecting a round to an adjacent round for forming a belt, are described.

2 Claims, 3 Drawing Figures

MEANS FOR AND METHOD OF PROVIDING A FIRE PROTECTION FOR A CASELESS AMMUNITION

Recent trends in high performance armaments and, particularly armament for supersonic aircraft, are directed toward the use of a caseless ammunition. In order to provide means for firing several thousand rounds per minute, it has become necessary to eliminate the traditional metal casing and resort to caseless ammunition. One form of caseless ammunition utilizes a cylindrical, hollow or solid molding, formed from the propellant material.

Rounds are deposited in a belt and stored in a container. At present, there is no protection against a round being accidently ignited. Adjacent rounds of caseless ammunition are packaged in close proximity to one another and a flaming round can engulf an adjacent round and set off a chain reaction, leading back to the ammunition storage container. The result can be catastrophic.

An effective means for protecting a round that is engulfed by a fire in an adjacent round, particularly for aircraft, must meet the following criteria, namely:

1. The fire protection means must be lightweight;
2. It must be sized to fit within the space limitations of the armament materials handling system and storage containers;
3. It must provide protection for about 45 to 90 seconds, i.e., the time necessary for a fire in an adjacent round to burn itself out; and
4. Finally, the fire protection means must be compatible with the materials handling mechanism of the armament system. In other words, the fire protection means must be readily formed into a belt and stripped from the round prior to the round being inserted in the armament.

Objects of the invention are to provide means for and a method of providing a fire protection case for caseless ammunition which:

a. avoids limitations and disadvantages of prior situations;
b. is compatible with existing armament systems;
c. fully protects a caseless ammunition round which is engulfed by a fire as, for example, from an adjacent round;
d. includes structural means for mechanically protecting the round;
e. includes means for joining a round to an adjacent round for forming a belt;
f. is lightweight, mechanically strong and is reasonably dimensioned; and
g. includes means for stripping the fire protective case from the round.

In accordance with the invention, a method of providing a fire protection casing for a caseless ammunition round comprises the steps of encasing the round in a heat sink material and covering the heat sink material with an outer coating of an intumescent material.

Also in accordance with the invention, a fire protection casing for a caseless ammunition round comprises an intumescent composite which completely encloses the ammunition round and, said composite material includes a longitudinal flap which may be mechanically engaged for stripping the casing from the round.

The novel features that are considered characteristic of the invention are set forth in the appended claims; the invention itself, however, both as to its organization and method of operation, together with additional objects and advantages thereof, will best be understood from the following description of a specific embodiment when read in conjunction with the accompanying drawings, in which:

Figure 1:
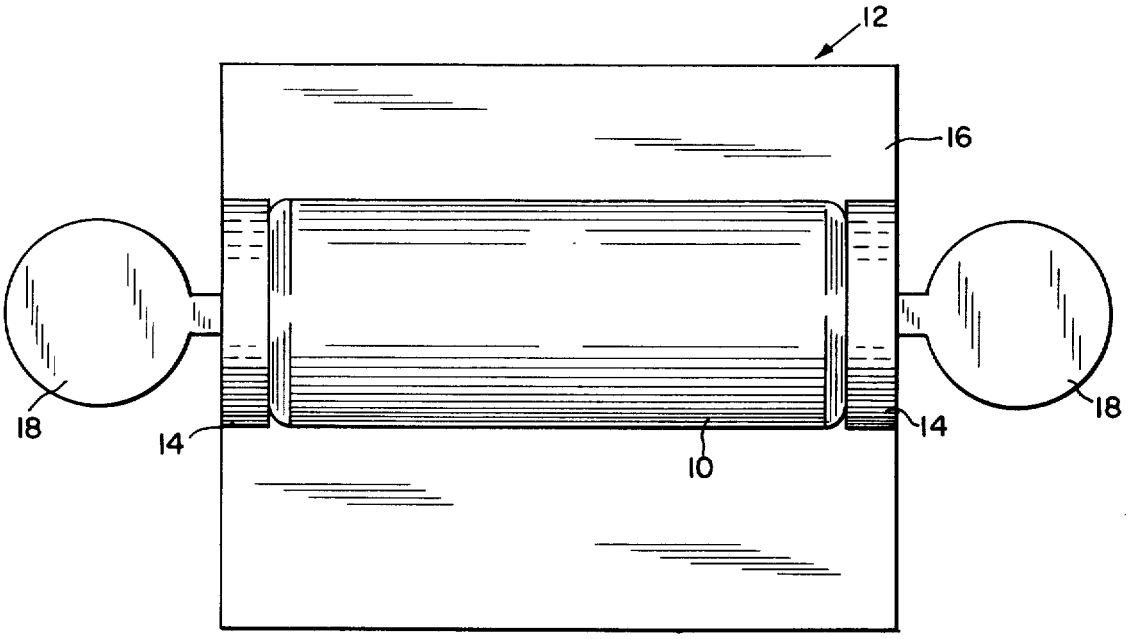
FIG. 1 shows a caseless ammunition round positioned on a preformed fire protection case. Structural protection means are also depicted.

Referring to FIG. 1, there is shown a caseless ammunition round 10 positioned on a preformed fire protection casing 12. Adjacent to each end of the round 10 is a structural disc 14 having the same diameter as the round 10. The structural disc 14 provides protection against impact. It also is an added insulator.

The fire protection casing 12 is preformed into a cylindrical portion 16, which is intended to be wrapped around the cylindrical portion of the round 10 and the structural disc 14. End portions 18 of a circular configuration also form part of the fire protection casing and these are intended to fold up and cover the end of the round 10 and the structural disc 14.

Figure 2:
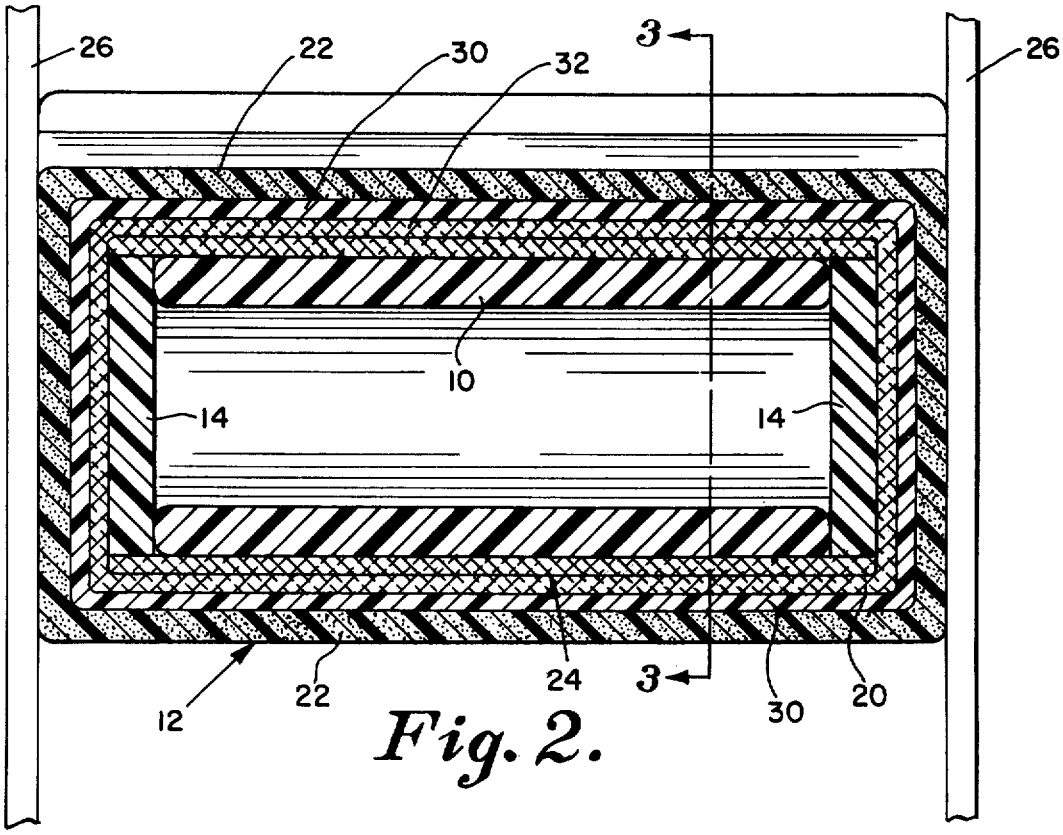
FIG. 2 is a cross-sectional representation of a round fully encased in a fire protection casing embodying the principles of the present invention.

The structural details of the fire protection casing 12 are shown in FIG. 2. The round 10 is first enclosed within an aluminum foil 20. The aluminum foil acts as a heat sink for diminishing or eliminating hot spots that may be generated within the fire protection casing 12. The aluminum foil is itself covered by a composite intumescent material 22. Situated between the composite intumescent material 22 and the aluminum foil 20 is a layer of an insulator 30 having heat reflecting coating 32 thereon. The insulator 30 and heat reflector 32 comprise a means 24 for accelerating the temperature rise within the composite intumescent material 22.

A wire 26 is cemented or otherwise attached to the end of the covered round for the purpose of mechanically coupling a round to an adjacent round for constructing a belt.

Although aluminum is preferred for the heat sink 20, any excellent heat conductor would be suitable, obviously.

Briefly, the composite intumescent material consists of a glass fabric which has been fully impregnated with an intumescent "paint."

The surface of the accelerating means 24 that is intended to be located between the intumescent material and the round, is preferably made from a sheet of 2 mil polyimide 30 containing a vapor deposited aluminum coating 32. The vapor deposited aluminum coating 32 is positioned next to the heat sink 20. The purpose of the polyimide and vapor deposited aluminum is twofold. It delays the conduction of heat from the composite intumescent material 22 to the heat sink 20, and it accelerates the temperature rise within the composite intumescent material so as to accelerate the activation thereof by reflecting heat back into the intumescent material. The purpose of accelerating the activation of the intumescent material is to accelerate the production of a stable char. As was explained in the above-referenced co-pending application, the faster the intumescent material is converted to a stable char, a greater protection the intumescent material will afford. For example, in the absence of the accelerating means 22, a composite intumescent material having a thickness of 20 mils will provide about 20 seconds of protection when the round is engulfed by a fire.

A twin of the composite intumescent material containing the accelerating means 24 will protect the heat sink 20 for a period of about 63 seconds.

Figure 3:
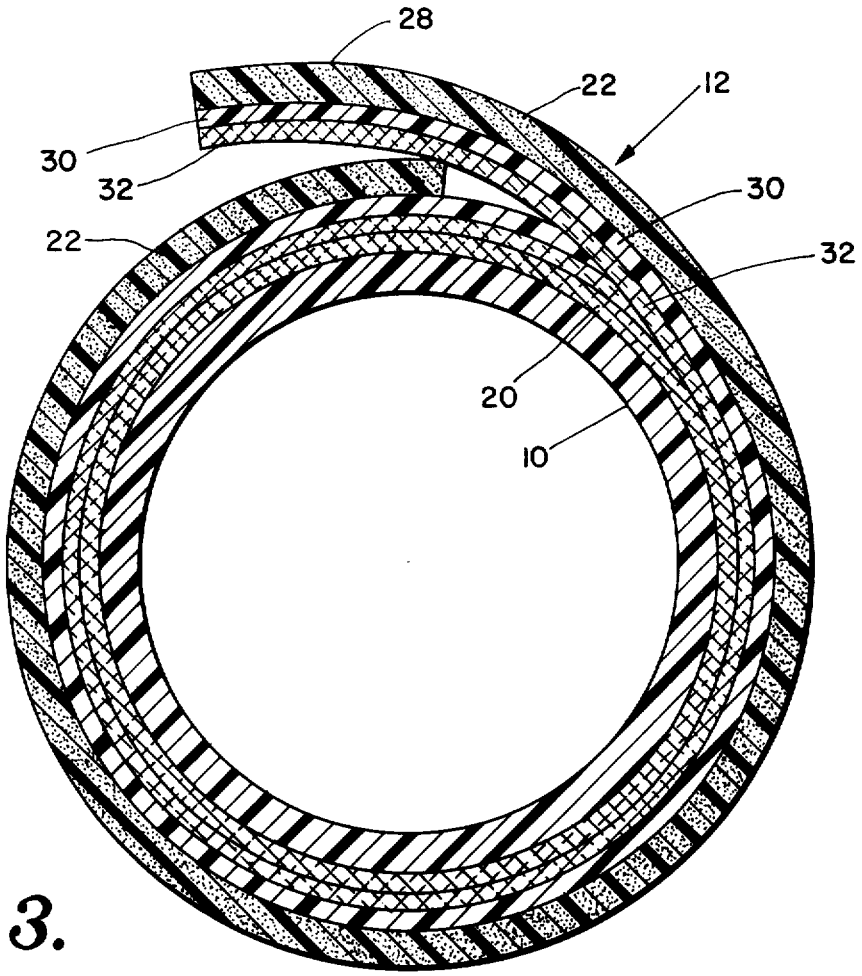
FIG. 3 is a cross-sectional representation taken along line 3—3 of FIG. 2.

Further details of the fire protection casing are shown in FIG. 3 which is a cross-section taken along lines 3—3 of FIG. 2. In particular, it will be noted that the casing comprises a single layer wrapper around the round 10 and heat sink 20. The casing includes a longitudinal flap 28 which is used to complement a mechanical means within the armament system for stripping the casing from the round. The two ends of the casing are initially bonded to the discs 14.

The covered round is then placed in a pressurized mold and subjected to a forming temperature which is substantially below the activation temperature of the intumescent material. The heat and pressure of the mold set the casing and bonding material so that they conform more completely to the shape of the round and discs.

The various features and advantages of the invention are thought to be clear from the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims:

We claim:

1. A fire protecting means for a caseless ammunition round comprising:

a structural disc having the same diameter as the round positioned adjacent to each end of the round;

a foil wrapper for enclosing at least the cylindrical surface of the round, said foil wrapper being made from heat conducting material to form a heat sink; and an outer wrapper encircling the round, the structural disc and the heat sink, said outer wrapper comprising an intumescent material, and terminating in a flap.

2. A fire protecting means for a caseless ammunition round comprising:

an inner wrapper formed from a heat sink material;

an outer wrapper comprising an intumescent material; and a layer of material for reflecting heat back into said intumescent material and/or insulating material for accelerating the activation of the intumescent material, said reflector and/or insulator being positioned between the intumescent material and said heat sink material.

* * * * *